United States Patent [19]

Yadrick

[11] Patent Number: 4,626,008

[45] Date of Patent: Dec. 2, 1986

[54] DOOR LOCK APPARATUS

[76] Inventor: Joseph M. Yadrick, One Biscayne Dr., Slovan, Pa. 15078

[21] Appl. No.: 553,794

[22] Filed: Nov. 21, 1983

[51] Int. Cl.[4] ..... E05C 1/14

[52] U.S. Cl. ..... 292/169.17; 74/526; 292/299; 292/336.3; 292/356; 292/DIG. 37

[58] Field of Search ..... 292/299, DIG. 37, 356, 292/359, 347, 336.3, 169.17, 169.18; 74/526, 565

[56] References Cited

U.S. PATENT DOCUMENTS 1,048,784 12/1912 Ackerman ..... 292/359
2,786,706 3/1957 Wright ..... 292/336.3
2,831,719 4/1958 Hitzelberger ..... 292/DIG. 37
3,535,977 10/1970 Baumgarten ..... 411/517

*Primary Examiner*—Robert L. Wolfe
*Assistant Examiner*—Lloyd A. Gall
*Attorney, Agent, or Firm*—Lawrence G. Zurawsky

[57] ABSTRACT

A locking prevention apparatus for attachment to the locking shaft of a passage lock door knob assembly for an interior door consists of a split ring of substantially rigid material which engages circumferentially the external surface of the locking shaft between the interior door knob and the interior face plate of said door knob assembly to limit translational motion of the interior door knob along the locking shaft toward the interior face plate.

4 Claims, 5 Drawing Figures

DOOR LOCK APPARATUS

BACKGROUND OF THE INVENTION

1. Field of the Invention

This invention relates to a locking prevention apparatus consisting of a split ring of substantially rigid material that engages circumferentially the locking shaft connecting the interior door knob of a passage lock assembly to the adjacent interior face plate to limit translational motion of the interior door knob along the locking shaft toward the interior face plate and thereby prevent accidental or unintentional locking of the door.

2. Description of the Prior Art

Interior rooms of buildings frequently have passage doors containing a passage lock door knob assembly in which the exterior door knob can be rotated to open and close the door but can not be actuated to lock the door, while the interior door knob assembly can be used to open and close the door as well as to lock the door from the interior of the room by sliding the interior door knob along the shaft connecting the interior door knob to the interior face plate of the door knob assembly and rotating the interior door knob to lock the door. Such passage lock assemblies are susceptible to the problem that the door can easily be locked accidently or unintentionally by an adult or by a child.

The prior art discloses several types of apparatus adapted to prevent opening, closing or unlocking of doors. For example, U.S. Pat. No. 2,786,706 discloses a rotatable latch engagement member retained in a normally inoperative position by a biasing force supplied by opposing springs mounted on opposite sides of the door between the door knobs and the face plates of the latch assembly. That apparatus maintains the latch assembly in an inoperative position; however, that condition can be readily overcome by urging the latching assembly into operation by either pulling or pushing on one of the door knobs. That apparatus merely increases the force necessary to operate the latch assembly but does not prevent locking of the latch assembly.

U.S. Pat. No. 2,883,850 discloses an apparatus adapted to prevent unlocking or opening of an exterior door, which apparatus includes a cylindrical casing which encloses the interior door knob and is secured in place by a yoke member which passes through slots in the cylindrical casing and is secured against removal by a conventional padlock. That apparatus permits locking of the door from the outside.

U.S. Pat. No. 3,980,328 discloses an apparatus which prevents unlocking a door from the outside, which apparatus includes a rigid door bar mounted across the exterior surface of the door and connected to the door jam. The door bar includes a yoke-like holding member which engages the shaft of the outside door knob and is tightened against the door bar by three fasteners, thereby squeezing the door knob between the yoke-like holding member and the door bar to prevent turning of the door knob. That apparatus does not disclose means to prevent unintentional locking of a door that remains in condition for normal passage use.

U.S. Pat. No. 3,084,965 discloses a cup shaped door knob guard which prevents children from opening doors by reaching the door knob from below. The top portion of the guard is open to permit operation of the door knob from above. That apparatus does not prevent accidental or unintentional operation and locking of the door knob assembly by persons other than small children. In addition, attachment of that apparatus requires at least partial disassembly of the door knob assembly.

U.S. Pat. No. 4,007,956 discloses an anti-theft device that prevents unlocking of an exterior door having a key actuated locking mechanism. That device is adapted to assure that normal operation of the locking and unlocking functions can be performed in the normal manner. Installation of that device requires disassembly of the door knob assembly.

There remains a need for a simply constructed, easily installed or removed, lock prevention apparatus for passage lock assemblies on interior doors.

SUMMARY OF THE INVENTION

In accordance with the present invention there is provided a locking prevention apparatus for attachment to a passage lock door knob assembly comprising a split ring of substantially rigid material adapted to engage circumferentially the external surface of the locking shaft between the interior door knob and the interior face plate of the door lock assembly to limit translational motion of the interior door knob along the locking shaft toward the interior face plate. The split ring includes an opening between the opposing adjacent end faces of the split ring to permit easy selective attachment to, or removal from, the door knob assembly.

Accordingly, it is an object of the present invention to provide a locking prevention apparatus for the passage lock assembly of an interior door that permits normal opening and closing of the door while preventing accidental or unintentional locking of the door.

Another object of the present invention is to provide a locking prevention apparatus for a passage lock assembly for an interior door that is simply and inexpensively constructed and is easily and readily attached to, or removed from, the passage lock door knob assembly, by an adult while preventing or impeding removal by a child.

Those and other objects of the present invention will be more completely disclosed and described in the following specification, the accompanying drawings and the appended claims.

DESCRIPTION OF THE PREFERRED EMBODIMENT

Figure 1:
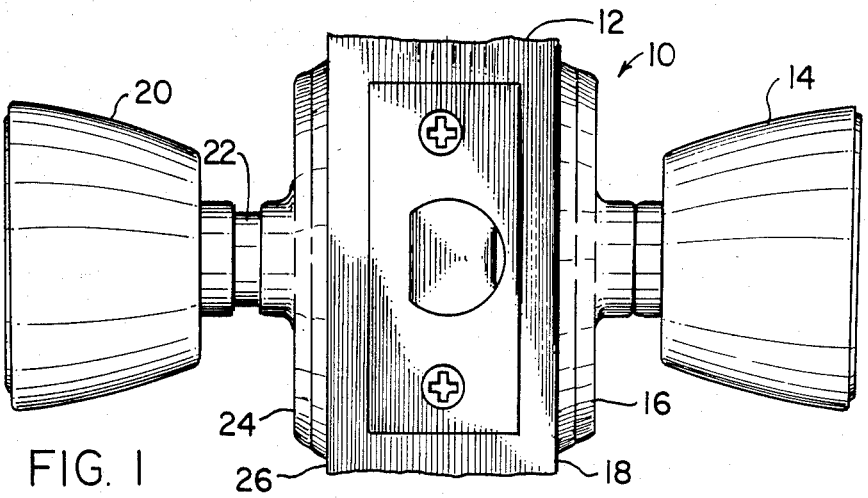
FIG. 1 is a side elevation view of a conventional passage lock door knob assembly, shown in the unlocked condition.

Referring to the drawings, FIG. 1 illustrates a passage lock door knob assembly indicated generally by reference numeral 10, mounted on opposite sides of a door 12 and having an exterior door knob 14 mounted adjacent an exterior face plate 16 on the exterior surface 18 of the door 12.

An interior door knob 20 is connected by a locking shaft 22 to an interior face plate 24 mounted on the interior surface 26 of door 12. The door knobs 14 and 20 are further connected to each other by a shaft (not shown in the drawing) or other suitable means well known in the art.

Figure 2:
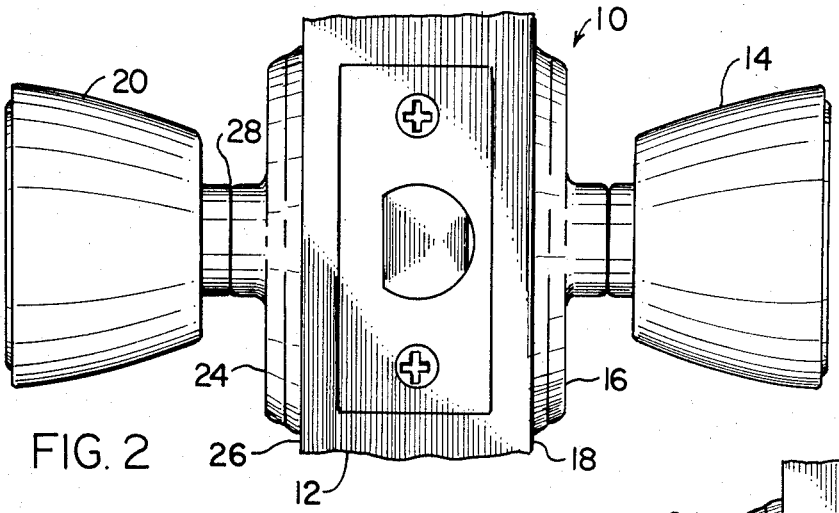
FIG. 2 is a side elevation view of a conventional passage lock door knob assembly shown in locked position.

Reference to FIG. 1 and FIG. 2 illustrates the normal operation of the passage lock door knob assembly 10 in which the interior door knob 20 is moved in translation along locking shaft 22 toward interior face plate 24 and rotated to lock interior door knob 20 in abutting relationship with interior face plate 24 as shown at 28 in FIG. 2.

Figure 3:
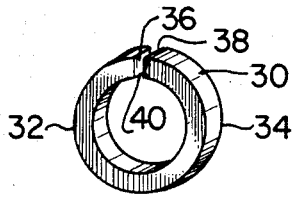
FIG. 3 is an isometric view of the split ring locking prevention apparatus of this invention.

The locking prevention apparatus of this invention is shown in FIG. 3 which illustrates a split ring 30 of circular configuration having side surfaces 32 and 34 and opposing end faces 36 and 38. Although split ring 30 is shown in FIG. 3 as having a circular configuration in this preferred embodiment, split ring 30 can have a configuration other than circular as long as split ring 30 is capable of engaging, in slidable relationship, the locking shaft 22 between interior door knob 20 and interior face plate 24.

The thickness of split ring 30 can be of any dimension suitable to permit the attachment of split ring 30 to locking shaft 22 in the space between interior door knob 20 and interior face plate 24 when the passage lock assembly 10 is in the unlocked position. Normally, when the passage lock door lock assembly is in the unlocked position, the length of locking shaft 22 exposed between interior door knob 20 and interior face plate 24 is between approximately 1/16 inch to approximately 3/16 inch. Consequently, the preferred thickness of split ring 30 is within the range of from 1/16 inch to 3/16 inch. Normally the most preferred thickness of split ring 30 is 2/16 inch.

Split ring 30 may be made of any material having sufficient rigidity or resistance to compression between the lateral surfaces 32 and 34 to limit the translational motion of interior door knob 20 in the direction of interior face plate 24 to the extent that the locking action of passage lock door knob assembly 10 is prevented. In a preferred embodiment, split ring 30 may be made of plastic, nylon, Teflon, hard rubber, metal or paper material such as hardened or reinforced pressed paper or cardboard. In a preferred embodiment of this invention, split ring 30 is made of plastic.

In split ring 30, the opposing end faces 36 and 38 define an opening 40 between end faces 36 and 38. The dimension of opening 40 in split ring 30 is adapted to permit the installation of split ring 30 on locking shaft 22 while preventing split ring 30 from falling off of locking shaft 22 accidently. The dimension of opening 40 and split ring 30 is further adapted to permit easy removal of split ring 30 from locking shaft 22 when it is desired to restore passage lock assembly 10 to normal locking operation. Although split ring 30 is of sufficient rigidity to prevent substantial deformation under compression of split ring 30 between interior door knob 20 and interior face plate 24, the construction and configuration of split ring 30 is adapted to permit torsional deformation of split ring 30 to facilitate placement of split ring 30 on locking shaft 22.

Figure 4:
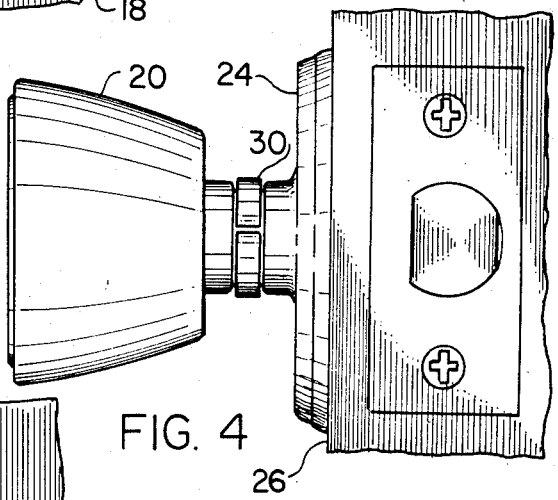
FIG. 4 is a side elevation view of the interior door knob of a passage lock door knob assembly, showing the split ring locking prevention apparatus mounted thereon to prevent locking.

FIG. 4 illustrates the apparatus of this invention with split ring 30 installed in place on locking shaft 22 between interior door knob 20 and interior face plate 24 to limit translational motion of interior door knob 20 toward interior face plate 24 and thereby prevent locking of the passage lock assembly 10.

Figure 5:
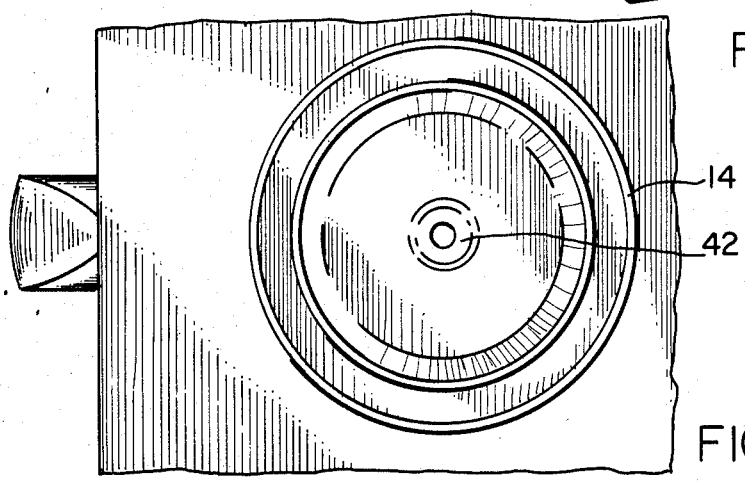
FIG. 5 is an end view of the exterior door knob of a conventional passage lock door knob assembly.

FIG. 5 illustrates the end view of exterior door knob 14 having an aperture 42 in the center thereof which, in the conventional passage lock assembly, permits insertion of a tool to release the locking mechanism of the assembly from the outside of the door. As can be seen from inspection of the drawings, the locking prevention apparatus of this invention does not interfer in any way with the lock release mechanism of the passage lock assembly.

The apparatus of this invention can be constructed simply of durable, inexpensive materials and can be installed or removed easily without disassembling the passage lock door knob assembly.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. In combination with a passage lock door knob assembly for an interior door having an exterior door knob abutting an exterior face plate and connected by a shaft extending through said door and through an interior face plate to an interior door knob, with said interior door knob connected by a locking shaft to said interior face plate, and normally unlocked lock means, lock operating means which can be activated to lock said lock means by advancing said interior door knob toward said interior face plate, the improvement comprising locking prevention apparatus consisting of a removable split ring of substantially rigid material adapted to engage circumferentially the external surface of said locking shaft between the interior door knob and the interior face plate of said door knob assembly, said split ring of substantially rigid material constructed and arranged to limit translational motion of said interior door knob toward said interior face plate, whereby locking of said lock means is prevented.

2. In the combination set forth in claim 1, improved locking prevention apparatus wherein said split ring of substantially rigid material is composed of material selected from the group consisting of plastic, nylon, Teflon, rubber, metal and paper.

3. In the combination set forth in claim 1, improved locking prevention apparatus wherein said split ring has a thickness within the range of from 1/16 inch to 3/16 inch.

4. In the combination set forth in claim 1, improved locking prevention apparatus wherein said split ring includes an opening between opposing adjacent end faces of the split ring having an opening width adapted to permit selective attachment of said split ring to, and selective removal of said split ring from, said locking shaft of said passage lock door knob assembly.

* * * * *